US008777830B2

(12) United States Patent
Toyoizumi et al.

(10) Patent No.: US 8,777,830 B2
(45) Date of Patent: Jul. 15, 2014

(54) PAPER FOLDING DEVICE FOR THREE-FOLDING SHEET OF PAPER

(75) Inventors: Teruhiko Toyoizumi, Tachikawa (JP); Takashi Watanabe, Toyokawa (JP); Hiroaki Takatsu, Nishio (JP); Hitoshi Asano, Toyokawa (JP); Takafumi Tanaka, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 475 days.

(21) Appl. No.: 13/157,563

(22) Filed: Jun. 10, 2011

(65) Prior Publication Data

US 2011/0319244 A1 Dec. 29, 2011

(30) Foreign Application Priority Data

Jun. 28, 2010 (JP) ..... 2010-146137

(51) Int. Cl.
*B31F 1/00* (2006.01)

(52) U.S. Cl.
USPC ..... 493/416; 493/8; 493/23; 493/434; 493/442

(58) Field of Classification Search
USPC ..... 493/8, 23, 434, 416, 442, 444
See application file for complete search history.

(56) References Cited

U.S. PATENT DOCUMENTS 5,242,364 A * 9/1993 Lehmann ..... 493/8
5,683,338 A * 11/1997 Krasuski et al. ..... 493/23
5,709,640 A * 1/1998 Timmermans et al. ..... 493/23
5,749,823 A * 5/1998 Richards ..... 493/417
6,024,682 A * 2/2000 Mandel et al. ..... 493/23
6,454,692 B2 * 9/2002 Ganneval et al. ..... 493/424
6,475,129 B1 * 11/2002 Lehmann ..... 493/421
6,641,514 B1 * 11/2003 Hechler ..... 493/8
6,743,161 B2 * 6/2004 Dannemann et al. ..... 493/442
7,077,798 B2 * 7/2006 Kawatsu et al. ..... 493/421
7,220,223 B2 * 5/2007 Erdt et al. ..... 493/25
2002/0025207 A1 2/2002 Yoshie et al.
2005/0020425 A1 * 1/2005 Kawatsu et al. ..... 493/424
2005/0189688 A1 9/2005 Suzuki et al.
2007/0063409 A1 3/2007 Sugimoto et al.
2009/0103934 A1 * 4/2009 Murakami ..... 399/45

FOREIGN PATENT DOCUMENTS

JP 5-319685 A 12/1993
JP 2001-341937 A 12/2001
JP 2002-060127 A 2/2002

(Continued)

OTHER PUBLICATIONS

Office Action (Decision to Grant Patent) dated May 15, 2012, issued in corresponding Japanese Patent Application No. 2010-146137, and an English Translation thereof. (6 pages).

*Primary Examiner* — Hemant M Desai
(74) *Attorney, Agent, or Firm* — Buchanan Ingersoll & Rooney PC

(57) ABSTRACT

In a paper folding device, a first driving unit for forming a first folding line on the paper moves a first folding plate member to the paper fed to a first feeding position until load on the first folding plate member reaches a prescribed value or higher. A time period from the start of driving of the first folding unit by the first driving unit to the start of driving of a second folding unit by a second driving unit is determined based on characteristic of paper.

12 Claims, 9 Drawing Sheets

(56) References Cited

FOREIGN PATENT DOCUMENTS

| | | | |
|---|---|---|---|
| JP | 2002-220154 | A | 8/2002 |
| JP | 2003-146534 | A | 5/2003 |
| JP | 2004-238201 | A | 8/2004 |
| JP | 2005-239413 | A | 9/2005 |
| JP | 2007-084171 | A | 4/2007 |
| JP | 2007-119197 | A | 5/2007 |

* cited by examiner

PAPER FOLDING DEVICE FOR THREE-FOLDING SHEET OF PAPER

This application is based on Japanese Patent Application No. 2010-146137 filed with the Japan Patent Office on Jun. 28, 2010, the entire content of which is hereby incorporated by reference.

BACKGROUND OF THE INVENTION

1. Field of the Invention

The present invention relates to a paper folding device for tri-folding sheets of paper.

2. Description of the Related Art

Conventionally, various techniques have been disclosed in relation to folding devices making two folding lines to provide tri-fold paper.

By way of example, Reference 1 (Japanese Laid-Open Patent Publication No. 05-319685) discloses a paper folding device executing two-fold mode and three-fold mode using first to third rollers. In the two-fold mode, a sheet of paper is fed by first and second rollers with feeding speed made different between the rollers, so that the sheet is curved. Then, the sheet is further fed with the curved portion carried between the first and third rollers. In the three-fold mode, after the curved sheet is carried between the first and third rollers, the feeding speed is made different between the first and third rollers so that the sheet is again curved, and the sheet is further fed with the curved portion carried between the first and second rollers.

Reference 2 (Japanese Laid-Open Patent Publication No. 2003-146534) discloses a paper post-processing device capable of executing saddle stitch processing, saddle fold processing and three-fold processing modes. In the paper post-processing device, based on the combination of process mode and paper size, stop position of position regulating means, to which the sheet of paper abuts and is positioned thereby, is determined in accordance with the combination of process mode and the size of paper loaded on a paper tray.

Reference 3 (Japanese Laid-Open Patent Publication No. 2002-220154) discloses a technique of folding a bundle of paper in three, using a folding knife, in a book binding machine. The process of folding a bundle of paper to three includes two steps of folding. Let us call the first step as the first folding step and the second step as the second folding step. In the book binding machine, the folding knife is used in the first folding step, and only the rollers are used in the second folding step. Positions of the rollers used in the second folding step are changed in accordance with the thickness of the bundle of paper.

Reference 4 (Japanese Laid-Open Patent Publication No. 2002-060127) discloses a technique that allows selective use of three-folding and two-folding functions in a post-processing device. In the three-folding function, a folding knife is used in the first folding step, and only the rollers are used in the second folding step. Reference 4 further discloses a technique of forming an image appropriate for the folding process on a sheet of paper, in an image forming apparatus combined with the post-processing device.

Reference 5 (Japanese Laid-Open Patent Publication No. 2001-341937) discloses a post-processing device in which folding knives are used in the first and second folding steps.

In the paper folding device, if the number of sheets as the object of one folding operation increases, problems such as crease generated during paper feeding or loose folding can better be avoided by using the folding knife, rather than using rollers only in the folding step. Therefore, it is preferred that the folding knife is used not only in the first folding step but also in the second folding step.

In Reference 5 in which the folding knives are used in the first and second folding steps, the timing of feeding the bundle of paper or the timing of operation of the folding knives are not mentioned.

For instance, the second folding step should be started after the end of the first folding step, when it is detected that the paper has reached an appropriate feeding position. In this regard, it is possible to determine the start timing of the second folding step by providing a sensor appropriately in the device. Provision of a sensor, however, leads to increased size and more complicated structure of the device, as well as higher manufacturing cost.

SUMMARY OF THE INVENTION

The present invention was made in view of the foregoing, and its object is, in a paper folding device for folding paper to three, to enable starting the step of creating the second folding line at an appropriate timing without increasing the manufacturing cost.

According to an aspect, the present invention provides a paper folding device, including: a first folding unit for forming a first folding line on paper fed to a first feeding position; a first driving unit for driving the first folding unit for forming the first folding line on the paper; a first feeding unit for feeding the paper, having the first folding line formed by the first folding unit, to a second feeding position; a second folding unit for forming a second folding line on the paper fed to the second feeding position; and a second driving unit for driving the second folding unit for forming the second folding line on the paper; wherein the first folding unit includes a pair of rollers, and a knife-shaped first folding plate member pushing the first folding line to the pair of rollers; and the first driving unit moves the first folding plate member to the paper fed to the first feeding position until load on the first folding plate member exceeds a prescribed value; the device further including: an obtaining unit obtaining a characteristic of the paper; and a determining unit for determining a time period from start of driving of the first folding unit by the first driving unit to start of driving of the second folding unit by the second driving unit, based on the characteristic of paper obtained by the obtaining unit.

Preferably, the time period determined by the determining unit becomes longer when number of sheets of paper as the characteristic of paper increases.

Preferably, the time period determined by the determining unit becomes longer when thickness of paper as the characteristic of paper increases.

Preferably, the obtaining unit is communicable with a paper feeding apparatus feeding paper to the first feeding position, and obtains the characteristic of paper fed to the first feeding position, from the paper feeding apparatus.

Preferably, the paper feeding apparatus is an image forming apparatus having formed an image on the paper fed to the first feeding position.

Preferably, the first feeding unit is also implemented by the pair of rollers.

Preferably, the first feeding unit starts an operation of feeding the paper at a timing having a prescribed relation from start of movement of the first folding plate member by the first driving unit; and the second driving unit starts driving of the second folding unit, on condition that the time period determined by the determining unit has passed after the start of operation for feeding the paper by the first feeding unit.

Preferably, the second folding unit includes a knife-shaped second folding plate member for forming the second folding line on the paper fed to the second feeding position, and the second driving unit drives the second folding unit by moving the second folding plate member to the paper fed to the second feeding position.

Preferably, the first feeding unit starts an operation of feeding the paper, having the first folding line formed, to the second feeding position on condition that the time period determined by the determining unit has passed from when the first driving unit started driving of the first folding unit.

Preferably, the device further includes a storage unit for storing the time period from the start of driving of the first folding unit to the start of driving of the second folding unit in association with characteristic of paper; wherein the determining unit determines the time period from the start of driving of the first folding unit to the start of driving of the second folding unit to be the time period stored in the storage unit in association with the characteristic of paper obtained by the obtaining unit.

Thus, in a paper folding device for providing tri-fold paper, the step of creating the second folding line can be started at an appropriate timing without increasing the manufacturing cost.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
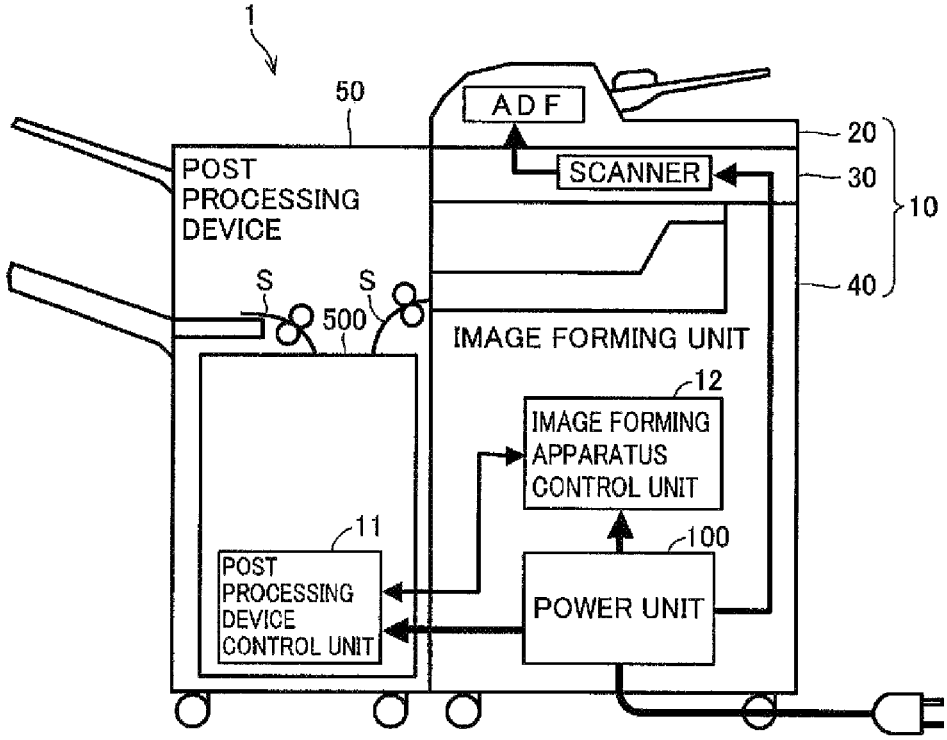
FIG. 1 schematically shows a configuration of an image forming system including the paper folding device in accordance with the present invention.

In the following, an embodiment of the present invention will be described in detail with reference to the figures. In the figures, elements having the same functions are denoted by the same reference characters, and description thereof will not be repeated.

[Schematic Configuration of Image Forming System]

FIG. 1 schematically shows a configuration of an image forming system including the paper folding device in accordance with the present invention.

Referring to FIG. 1, an image forming system 1 mainly consists of an image forming apparatus 10 for forming an image on a sheet of paper, and a post-processing device 50 for performing post processing such as folding of the sheets of paper on which images have been formed.

Image forming apparatus 10 includes: an auto document feeder (ADF) 20 for executing continuous automatic feeding of documents in copying and scanning operations; a scanner 30 generating image data of documents; and an image forming unit 40 forming images on a sheet of paper based on the image data generated by scanner 30 or based on image data stored beforehand. Image forming unit 40 includes a power unit 100 for supplying electric power supplied from an external AC source to various portions of image forming apparatus 10 and post-processing device 50; and an image forming apparatus control unit 12 for controlling overall operations of image forming apparatus 10.

Post processing device 50 includes a paper folding device 500 for folding sheets of paper fed from image forming apparatus 10. Paper folding device 500 includes a paper folding device control unit 11 for controlling overall operations of paper folding device 500.

[2. Configuration of Paper Folding Device]

Figure 2A:
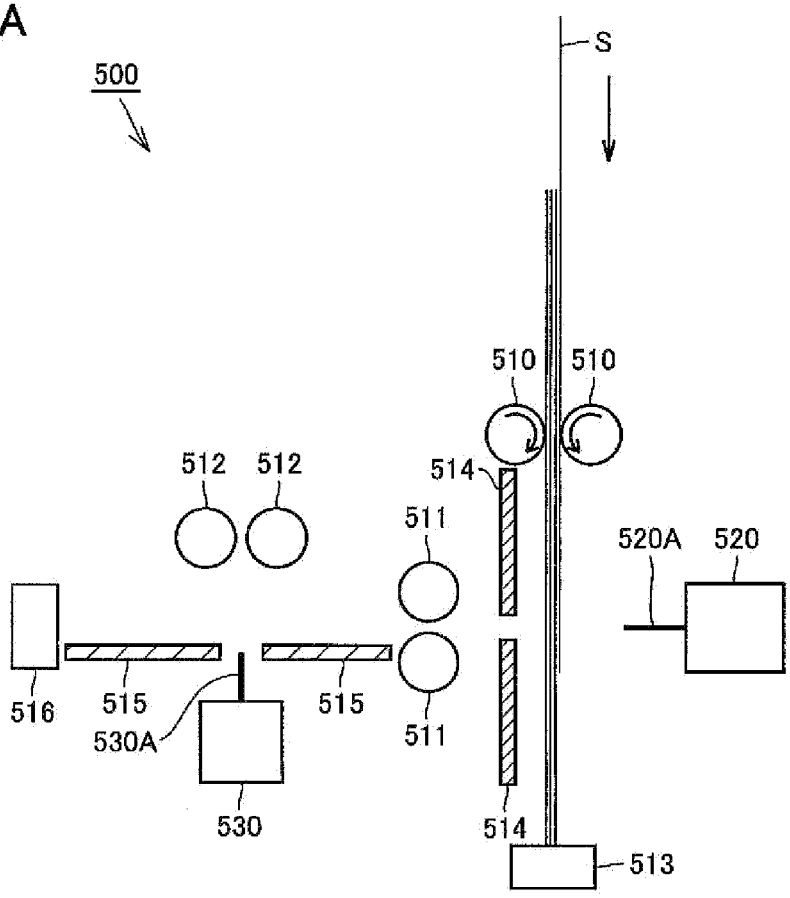
FIGS. 2A and 2B schematically show configurations of the paper folding mechanism in the paper folding device as an embodiment of the present invention.

FIG. 2A schematically shows an internal configuration of paper folding device 500.

Paper folding device 500 is a device for folding paper fed from image forming apparatus 100 to three. In order to fold the paper into three, paper folding device 500 forms two folding lines on the paper. The two folding lines are formed in order. In the present specification, the folding line formed first will be referred to as the "first folding line" and the line formed next will be referred to as the "second folding line."

Figure 2B:
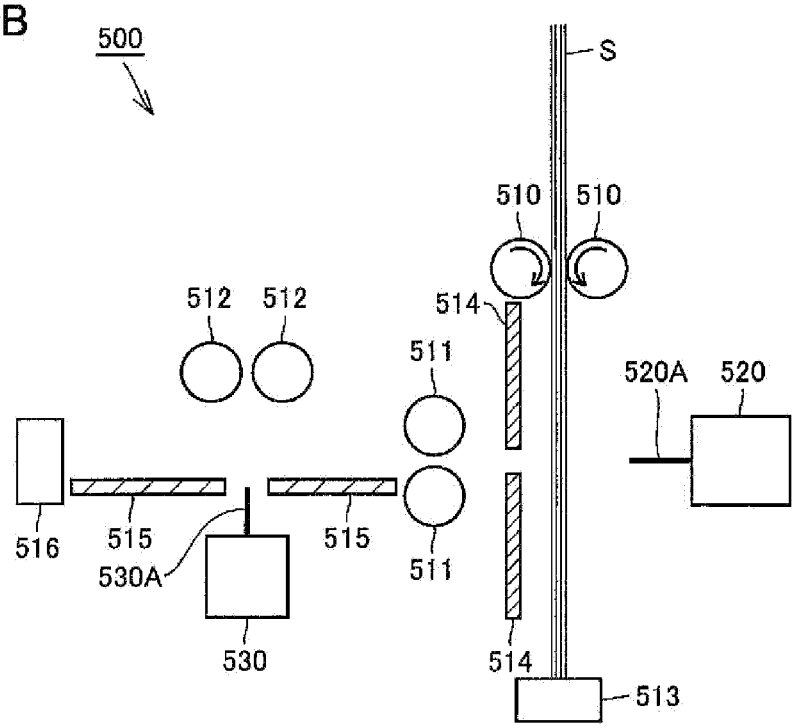

Paper folding device 500 includes a first folding knife unit 520 for forming the first folding line on the paper, and a second folding knife unit 530 for forming the second folding line on the paper on which the first folding line has been formed. Paper folding device 500 further includes feeding rollers 510 for feeding the paper fed from image forming apparatus 100 to a position where the first folding line is to be formed by first folding knife unit 520. The position where the paper is placed to have the first folding line formed by first folding knife unit 520 will be referred to as the first feeding position. Paper folding device 500 includes a stopper 513 for stopping the paper that has been fed by feeding rollers 510 at the first feeding position. FIG. 2B shows a state in which sheets of paper S are set at the first feeding position.

Paper folding device 500 further includes: feeding rollers 511 for feeding the paper having the first folding line formed by first folding knife unit 520 to a position where the second folding line is to be formed by the second folding knife unit 530; a support plate 514 for supporting the paper while the first folding line is formed by first folding knife unit 520; and a support plate 515 for supporting the paper while the second folding line is formed by second folding knife unit 530. The position where the paper is placed to have the second folding line formed by second folding knife unit 530 will be referred to as the second feeding position. Paper folding device 500 includes a stopper 516 for stopping the paper that has been fed by feeding rollers 510 at the second feeding position. Further, paper folding device 500 includes feeding rollers 512 for feeding the paper on which the second folding line is formed by second folding knife unit 530 to the outside of paper folding device 500 (or to a next process step in paper folding device 500).

First and second folding knife units 520 and 530 have knife-shaped blades 520A and 530A, respectively, which are protruded to the paper so that the first and second folding lines are formed. Support plates 514 and 515 have slits in which blades 520A and 530A are fitted.

[3. Control Block of Paper Folding Device]

Figure 3:
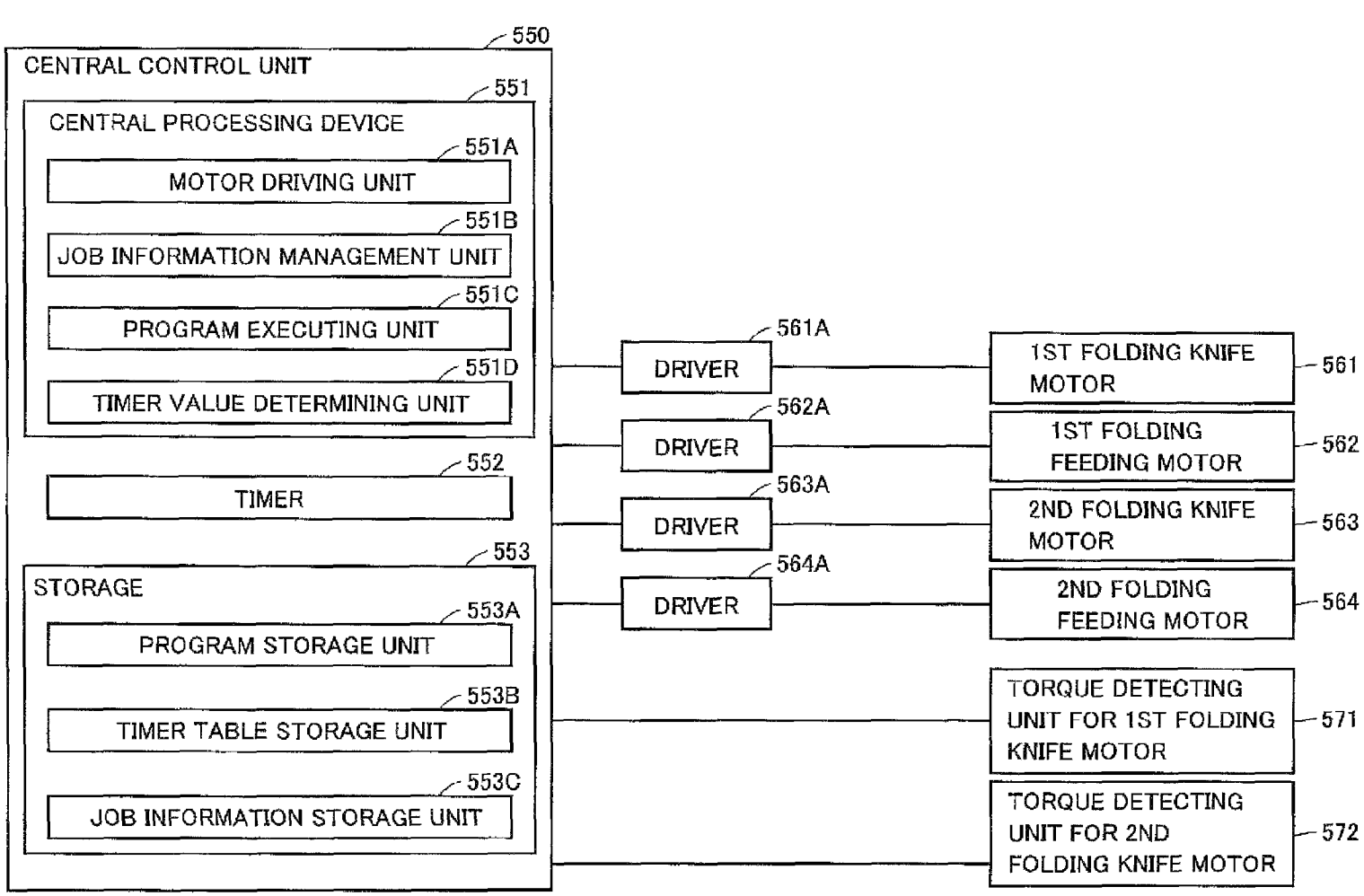
FIG. 3 is a control block diagram of the paper folding device in accordance with an embodiment of the present invention.

FIG. 3 is a control block diagram of paper folding device 500.

Referring to FIG. 3, paper folding device control unit 11 is configured to be communicable with image forming apparatus control unit 12 of image forming apparatus 10. Paper folding device 500 includes a first folding knife motor 561, a first folding feeding motor 562, a second folding knife motor 563 and a second folding feeding motor 564. First folding knife motor 561 is a motor for moving blade 520A of first folding knife unit 520 such that the blade is protruded to the paper or retracted to be housed in the body of first folding knife unit 520. First folding feeding motor 562 is for rotating feeding rollers 511. Second folding knife motor 563 is a motor for reciprocating blade 530A of second knife unit 530 so that it is moved closer to the paper that reached the second feeding position or retracted to be housed in the body of second folding knife unit 530. Second folding feeding motor 564 is for rotating feeding rollers 512.

Paper folding device control unit 11 includes a central control unit 550. Further, paper folding device control unit 11 includes a driver 561A for driving first folding knife motor 561, a driver 562A for driving first folding feeding motor 562, a driver 563A for driving second folding knife motor 563 and a driver 564A for driving second folding feeding motor 564. These drivers drive respective motors based on signals from central control unit 550.

Paper folding device control unit 11 further includes a torque detecting unit 571 for the first folding knife motor detecting load on first folding knife motor 561, and a toque detecting unit 572 for the second folding knife motor detecting load on second folding knife motor 563.

Central control unit 550 includes a central processing device 551, a timer 552, and a storage 553. Central processing device 551 includes a processor, such as a CPU (Central Processing Unit) or an MPU (Micro Processing Unit).

Storage 553 includes: a program storage unit 553A storing programs executed by central processing device 551; a timer value table storage unit 553B storing a timer value table used in processes executed by central processing device 551; and a job information storage unit 553C for storing job information related to sheets of paper fed from image forming apparatus 10. Image forming apparatus 10 executes an image forming operation job by job, and transmits the paper and job information including characteristics of the paper to post processing device 50 job by job. In job information storage unit 553C, the pieces of job information are stored.

Central processing device 551 includes, in order to control driving of respective motors described above, a motor drive control unit 551A for outputting control signals to drivers 561A, 562A, 563A and 564A, a job information management unit 551B receiving the pieces of job information transmitted from image forming apparatus 10 and storing the pieces of information in job information storage unit 553C, a program executing unit 551C executing programs stored in program storage unit 553A, and a timer value determining unit 551D determining a count value (timer value) to be set in a second folding start timer (TW), which will be described later.

Elements (other than storage 553) forming paper folding device control unit 11 may be implemented by software with programs stored in program storage unit 553A executed by program executing unit 551C, or part of or all of these elements may be implemented by hardware such as a dedicated LSI (Large Scale Integration) circuit.

[4. Paper Folding Process]

(1. Paper Folding Mechanism)

Referring to FIGS. 2B and 5 to 9, operations of various components when sheets of paper are folded by paper folding device 500 will be described.

Figure 5:
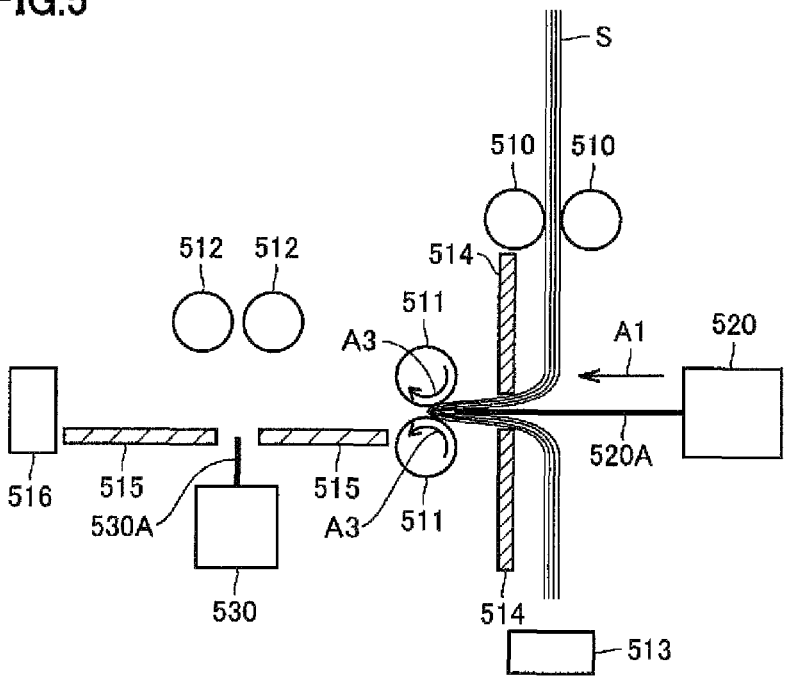
FIGS. 5 to 9 illustrate operations of the paper folding device when folding lines are created on the sheets of paper, in the paper folding device in accordance with an embodiment of the present invention.

As shown in FIG. 2B, when sheets of paper are fed from image forming apparatus 10 and all sheets of paper as an object of one folding operation are fed to the first feeding position, in paper folding device 500, blade 520A of first folding knife unit 520 is controlled such that it extends in the direction indicated by an arrow A1 in FIG. 5. The bundle of paper fed to the first feeding position is folded (folding line is formed) by blade 520A. The folding line formed here is the first folding line. Blade 520A is extended to a position where the first folding line (folded portion) formed on the bundle of paper is pinched between the feeding rollers 511, as shown in FIG. 5. In the present embodiment, feeding rollers 511 form a pair of rollers used when the first folding line is formed on the sheets.

Figure 6:
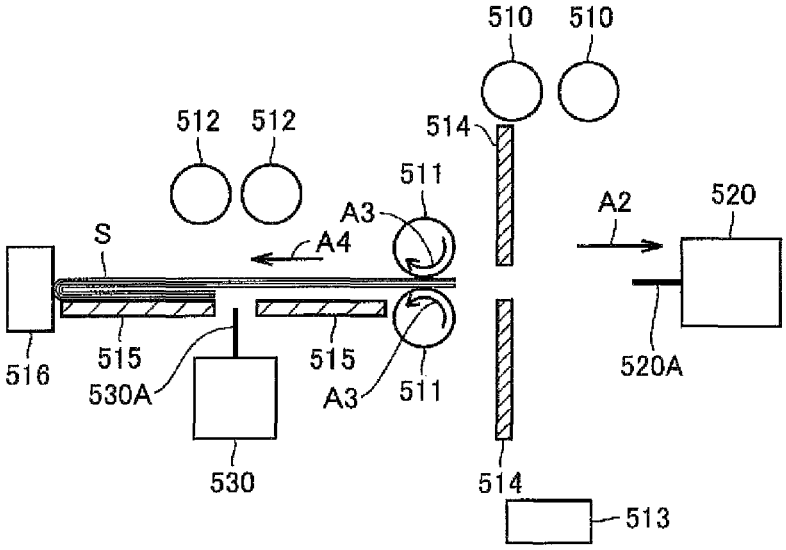
Figure 7:
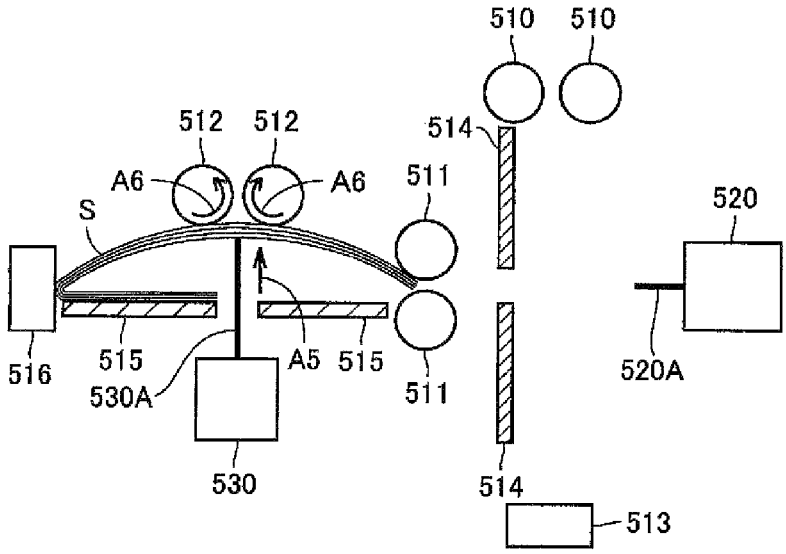

As first folding feeding motor 562 is driven, feeding rollers 511 are rotated in the direction of an arrow A3 in FIG. 5. Therefore, the paper bundle having the first folding line pinched by feeding rollers 511 is fed to the direction of an arrow A4 in FIG. 6, and abuts stopper 516. Thus, the paper bundle is set at the second feeding position. FIG. 6 shows the sheets of paper S set at the second feeding position.

One end of paper bundle set at the second feeding position still has one end pinched between feeding rollers 511. When feeding rollers 511 further rotate in this state in the direction of arrow A3, the paper bundle deforms, warped toward feeding rollers 512, as show in FIG. 7.

After the sheets that reached the second feeding position start to warp because of the rotation of feeding rollers 511, or when the sheets are set at the second feeding position as shown in FIG. 6, blade 530A of second folding knife unit 530 is extended in the direction of an arrow A5, that is, in the direction closer to the paper bundle.

When blade 520A is pinched together with the paper bundle between feeding rollers 511, blade 520A is retracted in the direction of an arrow A2 in FIG. 6, that is, in the direction to be moved backward and housed in the body of first folding knife unit 520. Blade 520A is retracted and housed in the body of first folding knife unit 520 as first folding knife motor 561 rotates in a direction opposite to when blade 520A is extended.

Returning to FIG. 7, blade 530A forms the second folding line on the paper bundle, and feeds the second folding line to a position to be pinched by feeding rollers 512.

Figure 8:
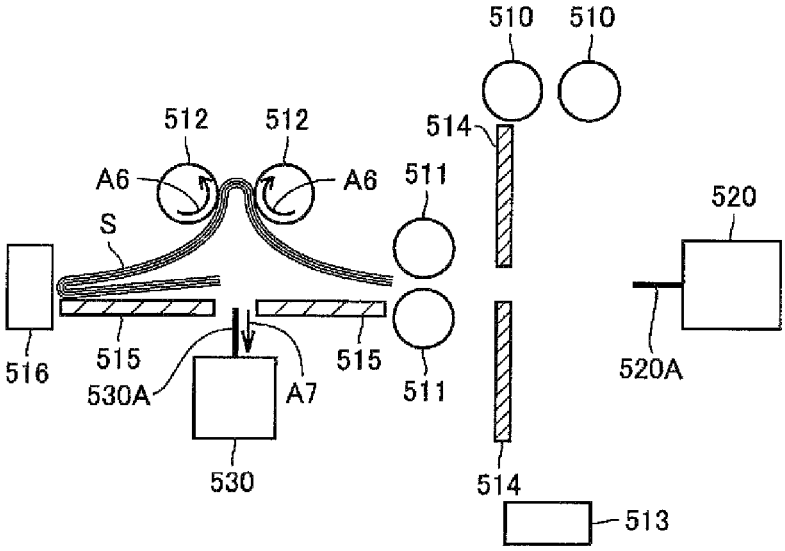
Figure 9:
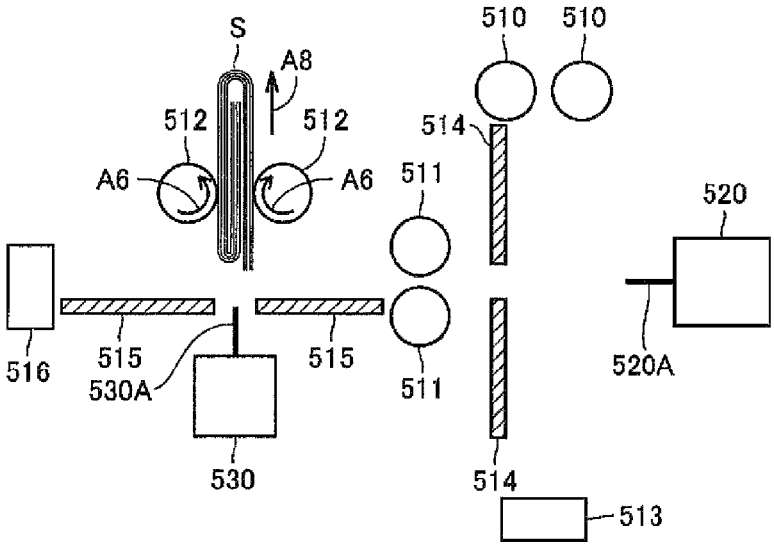

When second folding feeding motor 564 is driven and whereby feeding rollers 512 are rotated in the direction of an arrow A6, the paper bundle is fed to the upper direction in FIG. 8, that is, to the outside of paper folding device 500. FIG. 9 shows a state in which feeding rollers 512 are rotated continuously and the paper bundle is fed further to the direction of an arrow A8 than the state of FIG. 8.

When blade 530A is pinched together with the paper bundle between feeding rollers 512, blade 530A is retracted in the direction of an arrow A7 of FIG. 8, that is, in the direction to be moved backward and housed in the body of second folding knife unit 530. Blade 530A is retracted and housed in the body of second folding knife unit 530 as second folding knife motor 563 rotates in a direction opposite to when blade 530A is extended.

As feeding rollers 512 are continuously rotated in the direction of arrow A6, the paper bundle having the first and second folding lines formed by paper folding device 500 is fed to the outside of paper folding device 500.

In the present embodiment, driving of first folding knife motor 561 for extending blade 520A is continued until the paper bundle is folded and the folded portion (folding line) is pinched between feeding rollers 511. Specifically, driving is continued until the load on first folding knife motor 561 attains to a prescribed value or more, as will be described later. The time period from the start of driving of first folding knife motor 511 to extend blade 520A until the first folding line of paper bundle is pinched between feeding rollers 511 changes depending on how easily the sheet of paper can be folded.

Accordingly, if the time from the start of driving the first folding knife motor 561 to the start of driving the second folding knife motor 563 is made constant, the following problem is expected. Specifically, if the number of sheets to be folded is large or each sheet is thick, it takes long time until the first folding line is pinched between feeding rollers 511, so that blade 530A is extended before the paper bundle reaches the second feeding position and, as a result, the second folding line is formed at a position different from the originally intended position of the paper.

In view of the foregoing, in the present embodiment, the time period from the start of driving the first folding knife motor until the start of driving the second folding knife motor is determined in accordance with how easily the sheet of paper can be folded. In the following, an exemplary process contents realizing such control will be described with reference to FIG. 4.

(Contents of Paper Folding Process)

Figure 4:
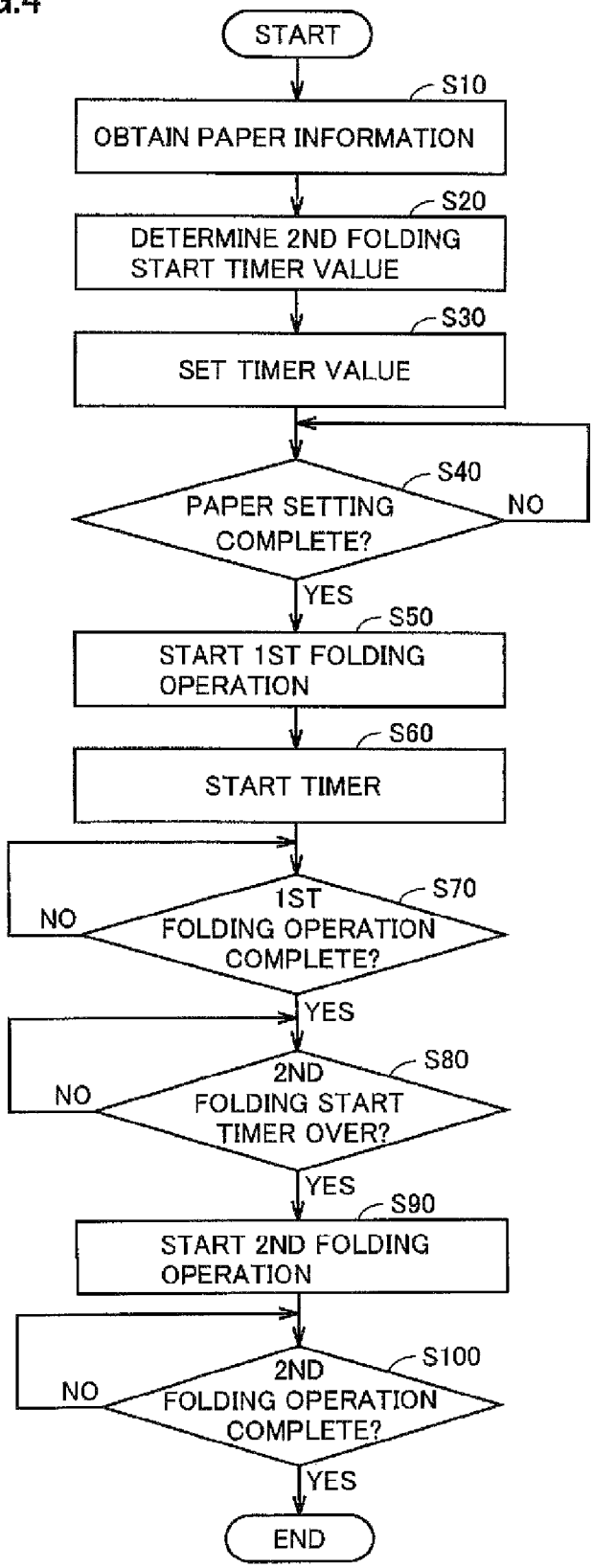
FIG. 4 is a flowchart of a paper folding process executed in the paper folding device in accordance with an embodiment of the present invention.

FIG. 4 is a flowchart of the paper folding process executed in paper folding device 500.

Referring to FIG. 4, at step S10, central processing device 551 obtains paper information of the paper that has been fed to the first feeding position, and the process proceeds to step S20.

In paper folding device 500, as the paper is transmitted from image forming apparatus 10, the paper is fed to the first feeding position. Central processing device 551 receives job information of the paper that comes to the first feeding position, from image forming apparatus control unit 12. Then, it obtains the paper information mentioned above, from the job information. Obtaining the paper information will be described in the following.

The job information transmitted from image forming apparatus control unit 12 is stored by job information management unit 551B in job information storage unit 553C.

The job information stored in job information storage unit 553C includes a piece of information of the job related to the paper that has reached the first feeding position, and a piece of information of the job related to the paper that has not yet reached the first feeding position but will be an object of paper folding process. Examples of the job information stored in job information storage unit 553C are shown as a job list in Table 1.

TABLE 1

| Job ID | Paper size | Number of sheets | Paper type |
|---|---|---|---|
| P0003 | A4 | 6 | Standard |
| P0004 | B5 | 10 | Thick |
| . . . | . . . | . . . | . . . |

Table 1 stores a plurality of pieces of job information, job by job, with each job having job ID. It is noted that only the sheets of paper as the object of one paper folding process are fed at one time to the first feeding position. A piece of job information registered in job information storage unit 553C related to a job of which paper folding process has been completed is deleted from job information storage unit 553C. The job information, however, may be kept in the job list after the end of processing.

Pieces of information specifying the paper size, the number of sheets and the paper type for each job are registered in the job list. At step S10, central processing device 551 obtains the paper information (number of sheets and paper type) of the job to be subjected to the paper folding process.

At step S20, central processing device 551 refers to the timer value table stored in timer table value storage unit 553B and determines the timer value to be set in the second folding start timer (TW), and the process proceeds to step S30. Table 2 shows an example of the timer value table stored in timer value table storage unit 553B.

TABLE 2

| Paper type | Number of sheets | Timer value (ms) |
|---|---|---|
| Thin paper | 1 | 880 |
| | 2 | 900 |
| | 3 | 920 |
| | 4 | 940 |
| | 5 or more | 960 |
| Standard paper | 1 | 940 |
| | 2 | 970 |
| | 3 | 1000 |
| | 4 | 1030 |
| | 5 or more | 1060 |
| Thick paper | 1 | 1000 |
| | 2 | 1050 |
| | 3 | 1100 |
| | 4 | 1150 |
| | 5 or more | 1200 |

In the timer table value shown in Table 2, timer values are indicated for each of three different types of paper (thin, standard and thick). Further, in the timer value table, for each type of paper, the timer value corresponding to the number of sheets is set. Central processing device 551 determines the time value associated with the combination of the number of sheets and the paper type obtained at step S10 to be the timer value to be set in the second folding start timer (TW).

At step S30, central processing device 551 reads the timer value determined at step S20 from timer value table storage unit 553B, and sets the value as the count value of second folding start timer (TW). Then, the process proceeds to step S40.

At step S40, central processing device 551 determines whether or not setting of the sheets of paper as the object of one paper folding operation fed from image forming apparatus 10 at the first feeding position is complete. If it is determined that the paper setting is complete, the process proceeds to step S50. Whether or not setting of paper is complete is determined based on timing information of feeding to paper folding device 500, related to the job involving the sheets of paper to be subjected to the paper folding process, from image forming apparatus control unit 12.

At step S50, central processing device 551 starts an operation of forming the first folding line (first folding operation) on the paper set at the first feeding position. Thereafter, the process proceeds to step S60. The first folding operation includes the operations of extending blade 520A to the paper bundle set at the first feeding position, forming the first folding line, and feeding the first folding line to feeding rollers 511.

At step S60, the count of second folding start timer (TW), of which count value was set at step S30, is started. Then, the process proceeds to step S70.

At step S70, central processing device 551 determines whether or not the first folding operation has been completed. If it is determined to be completed, the process proceeds to step S80. The determination as to whether the first folding operation has been completed at step S70 is made, for example, based on the magnitude of load on first folding knife motor 561 detected by torque detecting unit 571 for the first folding knife motor. Specifically, determination is made depending on whether or not the magnitude of load has reached a prescribed value or higher. The reason for this is as follows. When first folding knife motor 561 is continuously driven to extend blade 520A in the direction of arrow A1, the load on first folding knife motor 561 abruptly increases when blade 520A is pinched, together with the first folding line of the sheets of paper, between feeding rollers.

Torque detecting unit 571 for the first folding knife motor may directly detect the torque of first folding knife motor 561. Alternatively, the load on first folding knife motor 561 may be detected by detecting motor current of first folding knife motor 561 in a situation where electric power of constant voltage is applied to first folding knife motor 561.

Figure 11:
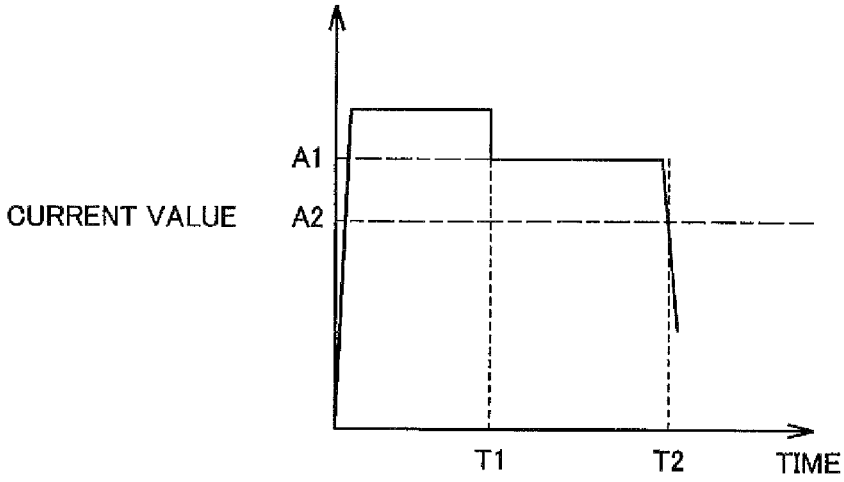
FIG. 11 illustrates the manner of detecting completion of a first folding operation in the paper folding process shown in FIG. 4.

When motor current detection is done, the motor current is assumed to change as shown in FIG. 11. In FIG. 11, the abscissa represents time passed from the start of power supply to the first folding knife motor 561. In the example shown in FIG. 11, it is assumed that at time T1, contact between blade 520A and the paper bundle fed to the first feeding position starts, and at time T2, blade 520A is pinched, with the first folding line formed on the sheets of paper, between feeding rollers 511.

The current value of motor current increases to a prescribed value when power supply to first folding knife motor 561 starts, and when blade 520A comes into contact with the paper, the current lowers to a current value A1. When blade 520A is pinched with the first folding line of the sheets of paper between rollers 511, the motor current value lowers abruptly.

In the present embodiment, in order to detect that blade 520A is pinched between feeding rollers 511 by detecting the motor current value, a current value A2, which is lower than the current value A1 expected for the paper to be the object of processing by paper folding device 500, is set, and if the motor current value becomes lower than the current value A2, it is detected that blade 520 is pinched between feeding rollers 511.

Returning to FIG. 4, if it is determined that the first folding operation is completed at step S70, central processing device 551 determines whether or not the count of second folding start timer (TW) is over at step S80. If it is determined that the timer is over, the process proceeds to step S90.

At step S90, central processing device 551 starts the operation (second folding operation) of forming the second folding line on the paper on which the first folding line has been formed. Then, the process proceeds to step S100. The second folding operation includes the operation of feeding the paper, on which the first folding line has been formed, to the second feeding position by rotating feeding rollers 511, and extending blade 530A to the paper fed to the second feeding position to form the second folding line.

At step S100, central processing device 551 determines whether or not the second folding operation started at step S90 is completed, and if it is determined to be completed, the paper folding process is terminated.

Determination as to whether the second folding operation is completed is made based on whether the magnitude of load on second folding knife motor 563 reached a prescribed value or higher, or whether the current value of the motor becomes lower than a prescribed value if electric power of constant voltage is supplied to second folding knife motor.

[5. Timing Chart]

Figure 10:
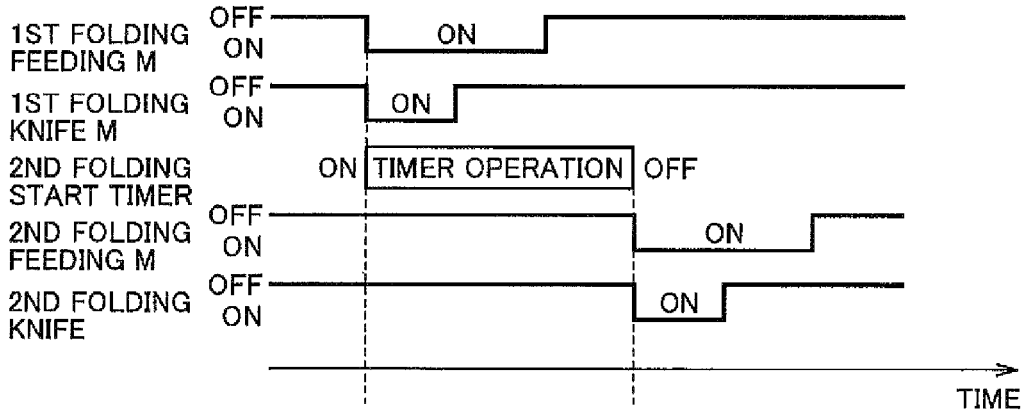
FIG. 10 is a timing chart of the paper folding process shown in FIG. 4.

FIG. 10 is a timing chart showing the timing of driving first folding feeding motor 562, first folding knife motor 561, second folding feeding motor 564 and second folding knife motor 563 as well as the period of counting operation of second folding start timer (TW).

The four motors mentioned above are OFF at the initial state. When the first folding operation starts (step S50), driving of first folding feeding motor 562 and first folding knife motor 561 is turned on. Further, the counting operation of second folding start timer (TW) starts.

Driving of first folding knife motor 561 is turned off when the load on first folding knife motor 561 exceeds a prescribed value, as described above.

First folding feeding motor 562 is kept on for a predetermined time period after the driving of first folding knife motor 561 is turned off, and thereafter, it is turned off. Here, the predetermined time period is the time period necessary for driving feeding rollers 511 to feed the paper, on which the first folding line is formed, to the second feeding position.

When the counting operation of second folding start timer (TW) ends, the second folding operation starts. Thus, driving of second folding feeding motor 264 and second folding knife motor 563 is turned on.

Driving of second folding knife motor 563 is turned off when the load on second folding knife motor 563 reaches a predetermined value or higher.

Driving of second folding feeding motor 564 is kept on for a predetermined time period after the driving of second folding knife motor 563 is turned off, and thereafter, it is turned off. Here, the predetermined time period is the time period necessary for driving feeding rollers 512 to feed the paper, on which the first and second folding lines are formed, to the outside of paper folding device 500 (or to the next step in paper folding device 500).

In paper folding device 500 in accordance with the embodiment described above, as the first folding operation, blade 520A of first folding knife unit 520 is protruded to the paper, whereby the first folding line is formed on the sheets of paper S. Then, as the second folding operation, blade 530A of second folding knife unit 530 is protruded to the paper on which the first folding line has been formed, whereby the second folding line is formed. Thus, tri-fold sheets S are provided. The time period from the start of first folding operation to the start of second folding operation is a time period stored in advance in relation to the characteristics of paper to be folded.

[6. Modifications]

(Timer Value Table)

In the embodiment described above, the time period from the start of driving first folding knife motor 561 to the start of second folding operation is the time period stored in advance in relation to the characteristics of paper to be folded by paper folding device 500.

As regards the stored time period, as can be seen from the timer value table of Table 2, as the thickness of paper increases from thin, standard to thick, the time period of timer value listed in association in timer value table becomes longer. When the paper type is the same, the time period of timer value listed in association in timer value table becomes longer if the number of sheets increases.

What is necessary in the present embodiment is that the time value is determined based on at least one characteristic. Therefore, the timer value table of Table 2 may be modified to the timer value table such as Table 3 or Table 4 below.

TABLE 3

| Number of sheets | Timer value (ms) |
|---|---|
| 1 | 900 |
| 2 | 950 |
| 3 | 1000 |
| 4 | 1050 |
| 5 or more | 1100 |

TABLE 4

| Paper type | Timer value (ms) |
|---|---|
| Thin | 900 |
| Standard | 1000 |
| Thick | 1100 |

In the timer value table of Table 3, the timer value is stored in relation to the number of sheets. In the timer value table of Table 4, the timer value is stored in relation to the paper type.

(Determination of Timer Value)

In the present embodiment, the timer value set in the second folding start timer (TW) is determined by selecting a value from the timer value table (see Table 2 etc.) stored in timer value table storage unit 553B. The manner of determining the timer value in the present invention, however, is not limited to the above. A program that calculates timer values such as listed in Table 2 based on the combination of paper type and the number of sheets may be stored in program storage unit 553A, and the timer value may be determined in accordance with the program.

(Obtaining Paper Characteristics)

Further, in the present embodiment, sheets of paper on which images have been formed by image forming apparatus 10 are fed to paper folding device 500. Paper folding device 500 obtains the characteristics of fed paper (number of sheets, type) from image forming apparatus 10. The apparatus that provides the characteristics of paper as the object of paper folding process and the apparatus that feeds the paper to paper folding device 500 may or may not be the same. Further, the apparatus that provides the characteristics of paper may not be an apparatus having the image forming function such as image forming apparatus 10. It may be an apparatus only for feeding paper (paper feeding apparatus), that is, an apparatus not having the image forming function.

Alternatively, an operation panel may be provided on paper folding device 500, and central processing device 551 may obtain information related to the characteristics of paper from the information input by the user operating the operation panel. Further, the apparatus that feeds paper to paper folding device 500 may not have the image forming function. What is necessary is only the paper feeding function. Alternatively, the user may set the sheets of paper as the object of paper folding process manually at the first feeding position.

(Timing of Motor Driving)

In the present embodiment described above, on condition that the timer value of second folding start timer (TW) has passed from the start of driving first folding knife motor 561, the second folding operation starts and driving of second folding knife motor 563 starts.

In the present embodiment, it is possible to start driving of second folding knife motor 563 on condition that a time period determined in accordance with the number of sheets and the thickness of paper has passed from the start of driving of first folding feeding motor 562, by starting driving of first folding feeding motor 562 simultaneously with (or at least with a constant time interval from) the start of driving of first folding knife motor 561.

Further, it is possible to start driving of second folding feeding motor 564 on condition that a time period determined in accordance with the number of sheets and the thickness of paper has passed from the start of driving of first folding knife motor 561, by starting driving of second folding feeding motor 564 simultaneously with (or at least with a constant time interval from) the start of driving of second folding knife motor 563. As a result, the time from the start of driving first folding knife motor 561 to the start of driving second folding knife motor 563 can be set to a time period in accordance with the number of sheets or paper thickness.

Further, driving of first folding feeding motor 562 may be started in accordance with the time period in accordance with the characteristic of how easily the paper can be folded, with respect to the start of driving of first folding knife motor 561. In timer table storage unit 553B, the time period (timer value) from the start of driving of first folding knife motor 561 to the start of driving first folding feeding motor 562 is stored in association with the number of sheets and/or thickness of paper. Central processing device 551 obtains the timer value related to the number of sheets and/or thickness of paper to be folded, from the stored values, and controls the time period from the start of driving first folding knife motor 561 to the start of driving first folding feeding motor 562.

(Rollers)

In the embodiment described above, the first folded portion is formed by first folding knife unit 520 and feeding rollers 511. Feeding rollers 511 form the first feeding unit feeding the paper, on which the first folding line is formed, to the second feeding position. Specifically, feeding rollers 511 function both as the first folding unit and the first feeding unit. Therefore, the number of components in paper folding device 500 can be reduced, and the cost can be reduced.

Figure 12:
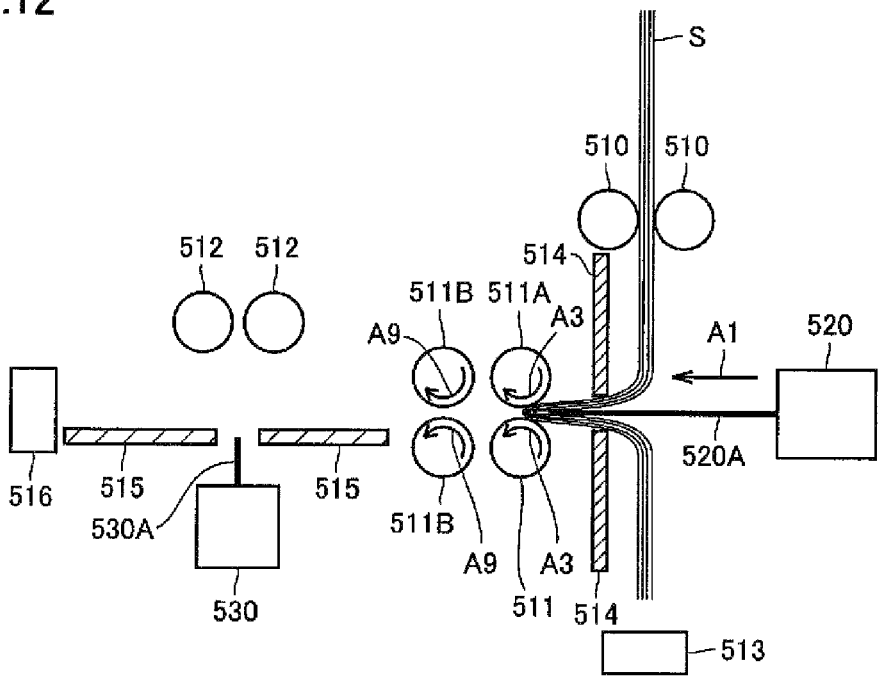
FIG. 12 illustrates a modification of the paper folding mechanism shown in FIGS. 2A and 2B.

FIG. 12 shows an exemplary configuration in which rollers forming the first folding unit and rollers forming the first feeding unit are separately provided.

In the example of FIG. 12, first folding knife unit 520 pushes the first folding line (folded portion) of the sheets of paper to folding rollers 511A. By the rotation of a motor, not shown, folding rollers 511A rotate in the direction of an arrow A3, and feed the sheets of paper to feeding rollers 511B. Feeding rollers 511B rotate in the direction of an arrow A9, and thereby feed the sheets of paper coming from folding rollers 511A to the second feeding position.

In the embodiment described above, the first folding plate member is pinched between a pair of rollers for feeding the first folding line and, therefore, the load received by the first folding plate member increases. Accordingly, movement of the first folding plate member by the first driving unit stops. Here, the time required until the movement is stopped changes depending on how easily the paper can be folded.

In accordance with the present embodiment, the timing from the start of movement of the first folding plate member until the start of driving of the second folding plate member is determined based on the time period stored in association with the characteristics of paper.

Therefore, if the time necessary for the first folding unit to form the first folding line changes in accordance with the characteristics of paper, it is possible to cause the second folding unit to start the operation to form the second folding line at a timing reflecting the change.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A paper folding device, comprising;

a first folding unit for forming a first folding line on paper fed to a first feeding position;

a first driving unit for driving said first folding unit for forming said first folding line on said paper;

a first feeding unit for feeding the paper, having said first folding line formed by said first folding unit, to a second feeding position;

a second folding unit for forming a second folding line on the paper fed to said second feeding position; and a second driving unit for driving said second folding unit for forming said second folding line on said paper; wherein said first folding unit includes a pair of rollers, and a knife-shaped first folding plate member pushing said first folding line to said pair of rollers; and said first driving unit moves said first folding plate member to the paper fed to said first feeding position until load on said first folding plate member exceeds a prescribed value;

said device further comprising;

an obtaining unit obtaining a characteristic of said paper; and a determining unit for determining a time period from start of driving of said first folding unit by said first driving unit to start of driving of said second folding unit by said second driving unit, based on the characteristic of paper obtained by said obtaining unit.

2. The paper folding device according to claim 1, wherein the time period determined by said determining unit becomes longer when number of sheets of paper as said characteristic of paper increases.

3. The paper folding device according to claim 1, wherein the time period determined by said determining unit becomes longer when thickness of paper as said characteristic of paper increases.

4. The paper folding device according to claim 1, wherein said obtaining unit is communicable with a paper feeding apparatus feeding paper to said first feeding position; and obtains the characteristic of paper fed to said first feeding position, from said paper feeding apparatus.

5. The paper folding device according to claim 4, wherein said paper feeding apparatus is an image forming apparatus having formed an image on the paper fed to said first feeding position.

6. The paper folding device according to claim 1, wherein said first feeding unit is also implemented by said pair of rollers.

7. The paper folding device according to claim 1, wherein said first feeding unit starts an operation of feeding said paper at a timing having a prescribed relation from start of movement of said first folding plate member by said first driving unit; and said second driving unit starts driving of said second folding unit, on condition that the time period determined by said determining unit has passed after the start of operation for feeding the paper by said first feeding unit.

8. The paper folding device according to claim 1, wherein said second folding unit includes a knife-shaped second folding plate member for forming said second folding line on the paper fed to said second feeding position; and said second driving unit drives said second folding unit by moving said second folding plate member to the paper fed to said second feeding position.

9. The paper folding device according to claim 8, wherein said first driving unit begins moving said first folding plate member toward said paper positioned in said first feeding position at said start of driving of said first folding unit and said second driving unit begins moving said second folding plate member toward said paper positioned in said second feeding position at said start of driving of said second folding unit so that said time period is a length of time between a start of movement of said first folding plate and a start of movement of said second folding plate.

10. The paper folding device according to claim 1, wherein said first feeding unit starts an operation of feeding the paper, having said first folding line formed, to said second feeding position, on condition that the time period determined by said determining unit has passed from when said first driving unit started driving of said first folding unit.

11. The paper folding device according to claim 1, further comprising a storage unit for storing the time period from the start of driving of said first folding unit to the start of driving of said second folding unit in association with the characteristic of paper; wherein said determining unit determines the time period from the start of driving of said first folding unit to the start of driving of said second folding unit to be the time period stored in said storage unit in association with the characteristic of paper obtained by said obtaining unit.

12. The paper folding device according to claim 1, wherein said first driving unit begins moving said first folding plate member toward said paper positioned in said first feeding position at said start of driving of said first folding unit.

* * * * *